US008325207B2

(12) United States Patent
Shen et al.

(10) Patent No.: US 8,325,207 B2
(45) Date of Patent: Dec. 4, 2012

(54) FRAME RATE ADJUSTER AND METHOD THEREOF

(75) Inventors: Tzu-Chiang Shen, Taoyuan County (TW); Hui-Chen Lin, Taoyuan County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 758 days.

(21) Appl. No.: 12/510,269

(22) Filed: Jul. 28, 2009

(65) Prior Publication Data

US 2010/0277512 A1 Nov. 4, 2010

(30) Foreign Application Priority Data

Apr. 30, 2009 (TW) ..... 98114333 A

(51) Int. Cl.
*G09G 5/10* (2006.01)

(52) U.S. Cl. ..... 345/690

(58) Field of Classification Search ..... 345/87, 345/89, 96, 690
See application file for complete search history.

(56) References Cited

U.S. PATENT DOCUMENTS

2003/0076886 A1* 4/2003 Nagata et al. ..... 375/240.25
2006/0033692 A1* 2/2006 Sako et al. ..... 345/87
2008/0170019 A1* 7/2008 Kato ..... 345/89

FOREIGN PATENT DOCUMENTS

CN 101331760 A 12/2008

* cited by examiner

*Primary Examiner* — Quan-Zhen Wang
*Assistant Examiner* — Tony Davis
(74) *Attorney, Agent, or Firm* — Winston Hsu; Scott Margo

(57) ABSTRACT

A frame rate adjuster is utilized for adjusting a frame rate of a display according to the brightness of a frame. The frame adjuster comprises a frame counting circuit, a brightness-counting circuit, a brightness-determining circuit, and a frame rate selecting circuit. The frame counting circuit is utilized for determining if gray-level data of the frame are all transmitted and accordingly generating a frame trigger signal. The brightness counting circuit is utilized for generating a plurality of brightness-counting numbers according to the gray-level data of the brightness of the frame. The brightness-determining circuit is utilized for outputting a brightness-determining signal according to the frame trigger signal and the plurality of the brightness-counting numbers. The frame rate selecting circuit is utilized for selecting a reference frame rate among a plurality of reference frame rates so as to adjust the frame rate of the display.

30 Claims, 4 Drawing Sheets

FRAME RATE ADJUSTER AND METHOD THEREOF

BACKGROUND OF THE INVENTION

1. Field of the Invention

The present invention is related to a frame rate adjuster, more particularly, to a frame rate adjuster which adjusts the frame rate of a display device according to the brightness of a frame.

2. Description of the Prior Art

When a display device displays frames, the frames are displayed according to the frame rate $R_F$. For instances, when the frame rate $R_F$ is 60 Hertz (Hz), the display device displays 60 frames in 1 second.

According to the prior art, the frame rate of the display device is a constant value. The relation between the frame rate of the display device and the power consumption is that the higher the frame rate $R_F$, the higher the power consumption of the display device, and vice versa. However, if the display device employs a lower frame rate $R_F$, display flickering occurs and is easily detected by human eyes when the brightness of the displayed frames is low.

Therefore, when the conventional display device employs a higher frame rate, the power consumption of the display device is increased; when the conventional display device employs a lower frame rate, the display device is prone to display flickering. Consequently, the power consumption of the display device cannot be reduced along with preventing the display flickering issue at the same time, causing great inconvenience.

SUMMARY OF THE INVENTION

The present invention discloses a frame rate adjuster, for adjusting a frame rate of a display device according to brightness of a frame. The frame rate adjuster comprises a frame counting circuit, a brightness counting circuit, a brightness determining circuit, and a frame rate selecting circuit. The frame counting circuit is for receiving the frame and calculating a number of received grey level data of the frame to determine if the frame has been completely received, for generating a frame triggering signal; wherein when the frame counting circuit determines the frame has been completely received, the frame counting circuit generates the frame triggering signal representing enable/reset. The brightness counting circuit is for receiving the frame and calculating brightness of the grey level data of the frame, for accordingly generating a plurality of brightness counting numbers; wherein when the frame triggering signal represents enable/reset, the brightness counting circuit resets the plurality of the brightness counting numbers. The brightness determining circuit is for outputting a brightness determining signal according to the frame triggering signal and the plurality of the brightness counting numbers; wherein when the frame triggering signal represents enable/reset, the brightness determining circuit outputs the brightness determining signal according to the plurality of the brightness counting numbers. The frame rate selecting circuit comprises a control end, for receiving the brightness determining signal, an enable end, for receiving the frame triggering signal and an output end, for generating an output frame rate; wherein when the frame triggering signal represents enable/reset, the frame rate selecting circuit selects one of a plurality of reference frame rates to be the output frame rate according to the brightness determining signal, and the output frame rate is utilized as the frame rate of the display device.

The present invention further discloses a frame rate adjuster, for adjusting a frame rate of a display device according to brightness of a predetermined number of frames. The frame rate adjuster comprises a frame counting circuit, an interval counting circuit, a brightness counting circuit, a brightness determining circuit, a frame rate selecting circuit and a frame rate calculating circuit. The frame counting circuit is for receiving the predetermined number of the frames and calculating a number of received grey level data of the predetermined number of the frames, to determine if an frame of the predetermined number of the frames has been completely received, for generating a frame triggering signal; wherein when the frame counting circuit determines the frame of the predetermined number of the frames has been completely received, the frame counting circuit generates the frame triggering signal representing enable/reset. The interval counting circuit is for counting a number of times the frame triggering signal represents enable/reset, for determining if the predetermined number of the frames have been completely transmitted, and accordingly generating an interval triggering signal; wherein when the number of times the frame triggering signal represents enable/reset equals the predetermined number, the interval counting circuit generates the interval triggering signal representing enable/reset. The brightness counting circuit is for receiving the predetermined number of the frames, and calculating brightness of the grey level data of the predetermined number of the frames, for generating a plurality of brightness counting numbers; wherein when the frame triggering signal represents enable/reset, the brightness counting circuit resets the plurality of the brightness counting numbers. The brightness determining circuit is for outputting a brightness determining signal according to the frame triggering signal and the plurality of the brightness counting numbers; wherein when the frame triggering signal represents enable/reset, the brightness determining circuit outputs the brightness determining signal according to the plurality of the brightness counting numbers. The frame rate selecting circuit comprises a control end, for receiving the brightness determining signal; an enable end, for receiving the frame triggering signal; and an output end, for generating an output frame rate; wherein when the frame triggering signal represents enable/reset, the frame rate selecting circuit selects one of plurality of reference frame rates to be the output frame rate according to the brightness determining signal. The frame rate calculating circuit is for receiving and storing the output frame rate outputted from the frame rate selecting circuit, and generating a calculated output frame rate as the frame rate of the display device, according to the stored output frame rate when the interval triggering signal representing enable/reset is received.

The present invention further discloses a method for adjusting a frame rate of a display device according to brightness of a frame. The method comprises calculating the brightness of grey level data of the frame for obtaining a plurality of brightness counting numbers; generating a brightness determining signal according to the plurality of the brightness counting numbers; and selecting one reference frame rate from a plurality of reference frame rates to be an output frame rate, according the brightness determining signal, and utilizing the output frame rate for adjusting the frame rate of the display device.

The present invention further discloses a method for adjusting a frame rate of a display device according to brightness of a predetermined number of frames, the method comprises calculating the brightness of grey level data of the predetermined number of the frames, for obtaining the predetermined number of sets of brightness counting numbers;

wherein each set of the brightness counting numbers of the predetermined number of sets of the brightness counting numbers comprises a plurality of brightness counting numbers; wherein a $M^{th}$ set of the brightness counting number of the predetermined number of sets of the brightness counting numbers is obtained by calculating a $M^{th}$ frame from the predetermined number of the frames; generating the predetermined number of the brightness determining signals according to the predetermined number of the sets of the brightness counting numbers; generating the predetermined number of output frame rates according to the predetermined number of the brightness determining signals and a plurality of reference frame rates; and generating a calculated output frame rate according to the predetermined number of the output frame rates, for adjusting the frame rate of the display device; wherein M represents a positive integer.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . " Also, the term "electrically connect" is intended to mean either an indirect or direct electrical connection. Accordingly, if one device is coupled to another device, that connection may be through a direct electrical connection, or through an indirect electrical connection via other devices and connections.

Therefore, for solving the issue that the power consumption cannot be effectively reduced for the conventional display device, the present invention discloses a frame rate adjuster for adjusting the frame rate of the display device according to the brightness of the frames. When the brightness of the frame is determined to be high, the frame rate of the display device is adjusted to be lower for reducing the power consumption; when the brightness of the frame is determined to be low, the frame rate of the display device is adjusted to be higher so as to prevent display flickering.

Figure 1:
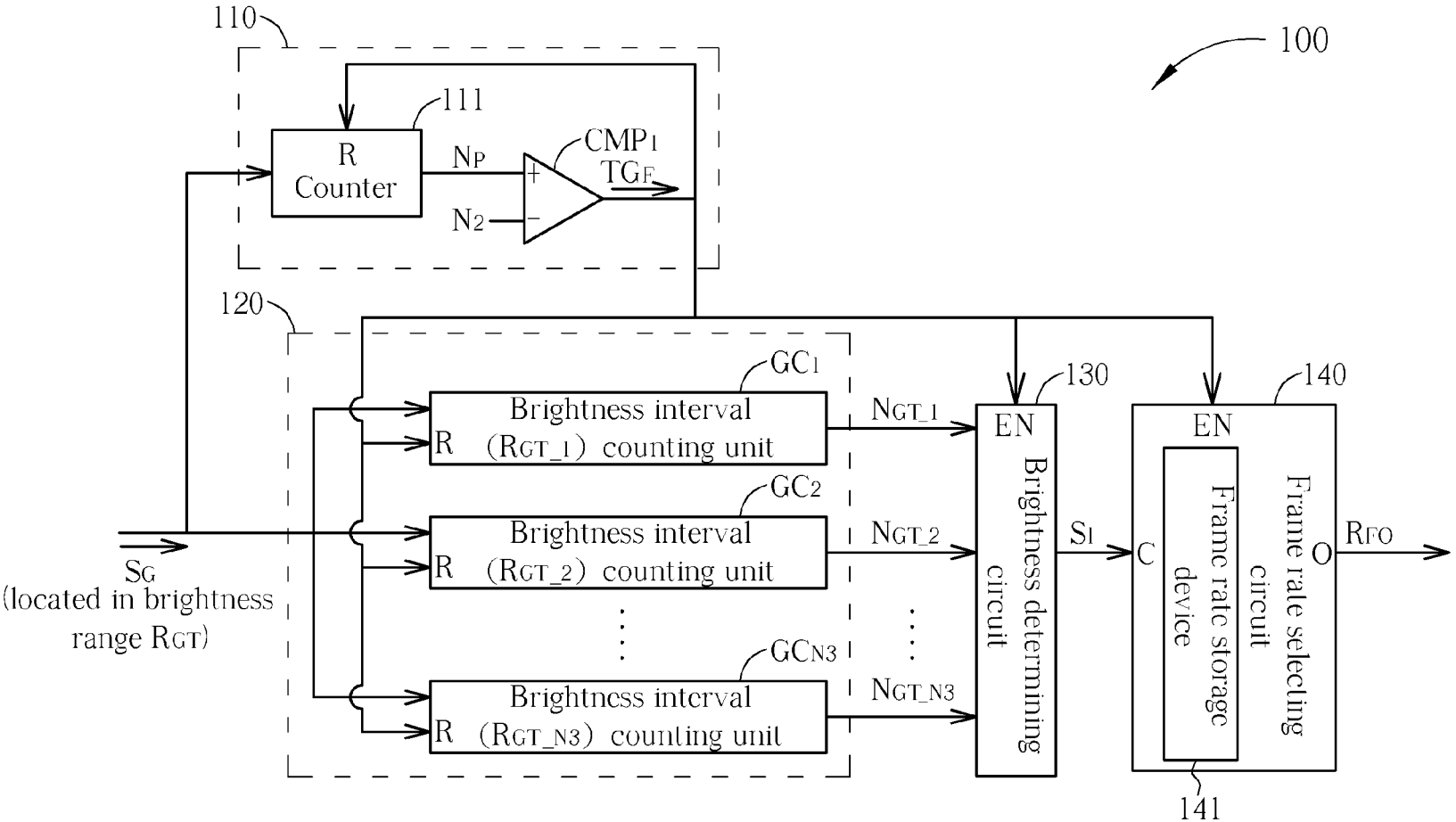
FIG. 1 is a diagram illustrating the frame adjuster according to the first embodiment of the present invention.

Please refer to FIG. 1. FIG. 1 is a diagram illustrating the frame adjuster 100 according to the first embodiment of the present invention. The frame rate adjuster 100 is utilized to adjust the frame rate of the display device which consists of $N_2$ pixels, according to the brightness of an original image lo, wherein the resolution of the original image $I_O$ is $N_2$, indicating the original image lo consists of the grey level data of $N_2$ pixels. The frame rate adjuster 100 comprises a frame counting circuit 110, a brightness counting circuit 120, a brightness determining circuit 130, and a frame rate selecting circuit 140.

The grey level signal $S_G$ is the grey level data of the original image $I_O$ sequentially received by the frame rate adjuster 100. The frame rate counting circuit 110 is utilized to determine wither the grey level data of an original image has been completely transmitted from the grey level signal $S_G$, according to the number of pixels of the transmitted grey level data of the grey level signal $S_G$, for generating the frame triggering signal $TG_F$. The frame counting circuit 110 comprises a counter 111 and a comparator $CMP_1$. The counter 111 receives the grey level signal $S_G$, for counting the number of pixels of the transmitted grey level data and accordingly obtaining a counted number $N_P$. Every time the counter 111 receives the grey level data of one pixel, the counted number $N_P$ is incremented by 1. For instances, assuming the counted number $N_P$ is X, when the counter 111 receives the grey level data of one pixel, the counted number $N_P$ becomes (X+1). The comparator $CMP_1$ compares the counted number $N_P$ and the number $N_2$ of pixels of the display device, for outputting the frame triggering signal $TG_F$. For instances, when the counted number $N_P$ equals the number $N_2$ of pixels of the display device, the comparator $CMP_1$ outputs the frame triggering signal $TG_F$ representing "enable/reset"; indicating the grey level data of an original image has been completely transmitted from the grey level signal $S_G$. When the reset end R of the counter 111 receives the frame triggering signal $TG_F$ representing "enable/reset", the counter 111 resets the counted number $N_P$ to a predetermined value (i.e. reset to zero). Therefore, every time when the frame counting circuit 110 determines the grey level of an original image has been completely transmitted from the grey level signal $S_G$, the frame counting circuit 110 generates the frame triggering signal $TG_F$ representing "enable/reset".

The brightness counting circuit 120 is utilized to count the number of pixels of the received grey level signal $S_G$ located in each of the brightness intervals $R_{GT_1}$~$R_{GT_N3}$ in the brightness range $R_{GT}$, as well as outputting the brightness counting number $N_{GT_1}$~$N_{GT_N3}$ accordingly calculated in each of the brightness intervals $R_{GT_1}$~$R_{GT_N3}$. The brightness counting circuit 120 comprises $N_3$ brightness interval counting units $GC_1$~$GC_{N3}$, wherein the brightness interval counting unit $GC_K$ is utilized to count the number $N_{GT_K}$ of pixels of the grey level signal $S_G$ that are located in the brightness interval $R_{GT_K}$, as well as outputting the brightness counting number $N_{GT_K}$ (i.e. K may be 1~$N_3$) accordingly. When the grey level signal $S_G$ is located in the brightness interval $R_{GT_K}$, the brightness counting unit $GC_K$ increments the brightness counting number $N_{GT_K}$ by 1. For instances, assuming the brightness range $R_{GT}$ represents the range of the grey levels 0~255 and assuming $N_3$ equals 4, the brightness interval $R_{GT_1}$ represents the range of the grey levels 0~63; the brightness interval $R_{GT_2}$ represents the range of the grey levels 64~127; the brightness interval $R_{GT_3}$ represents the range of the grey levels 128~191; the brightness interval $R_{GT_4}$ represents the range of the grey levels 192~255. Furthermore, assuming the brightness counting numbers $N_{GT_1}$~$N_{GT_4}$ of the brightness interval counters $GC_1$~$GC_4$ are $[X_1,X_2,X_3,X_4]$, when the brightness counting circuit 120 receives the grey level signal $S_G$ representing the grey level "30", the brightness counting numbers $N_{GT_1}$~$N_{GT_4}$ become $[(X_1+1),X_2,X_3,X_4]$; when the brightness counting circuit 120 receives the grey level signal $S_G$ representing the grey level "70", the brightness counting numbers $N_{GT_1}$~$N_{GT_4}$ become [$X_1$+1,($X_2$+1),$X_3$,$X_4$]; when the brightness counting circuit 120 receives the grey level signal $S_G$ representing the grey level "150", the brightness counting numbers $N_{GT_1}$~$N_{GT_4}$ become [$X_1$,$X_2$,($X_3$+1), $X_4$]; when the brightness counting circuit 120 receives the grey level signal $S_G$ representing the grey level "220", the brightness counting numbers $N_{GT_1}$~$N_{GT_4}$ become [$X_1$,$X_2$, $X_3$,($X_4$+1)]. In addition, when each reset end of the brightness interval counting units $GC_1$~$GC_{N6}$ receives the frame triggering signal $TG_F$ (i.e. indicating the grey level data of an original image has been completely transmitted from the grey level signal $S_G$), each of the brightness interval counting units $GC_1$~$GC_{N3}$ resets the corresponding brightness counting numbers $N_{GT_1}$~$N_{GT_N3}$ respectively to a predetermined value (i.e. reset to zero).

The brightness determining circuit 130 outputs the brightness determining signal $S_I$ according to the frame triggering signal $TG_F$ and the brightness counting numbers $N_{GT_1}$~$N_{GT_N3}$. When the enable end EN of the brightness determining circuit 130 receives the frame triggering signal $TG_F$ representing "enable/reset" (i.e. indicating the grey level data of an original image has been completely transmitted from the grey level signal $S_G$), the brightness determining circuit 130 outputs the brightness determining signal $S_I$ according to the brightness counting numbers $N_{GT_1}$~$N_{GT_N3}$. Meanwhile, if the brightness counting number $N_{GT_K}$ outputted by the brightness counting unit $GC_k$ is the maximum value (i.e. the value of the brightness counting number $N_{GTK}$ is larger relative to the other brightness counting numbers) among the brightness counting numbers $N_{GT_1}$~$N_{GT_N3}$, it indicates that the brightness of the original image is mostly distributed in the brightness interval $R_{GT_K}$. As a result, the brightness determining signal Si outputted by the brightness determining circuit 130 represents "K". Therefore, by comparing the brightness counting number of each brightness interval, the brightness determining circuit 130 is able to obtain the brightness distribution of the original image and output the brightness determining signal $S_I$ accordingly. When the brightness determining signal $S_I$ indicates that the brightness of the original image $I_O$ is distributed mostly in the high brightness interval, the original image $I_O$ is determined to be a high brightness image; when the brightness determining signal $S_I$ indicates that the brightness of the original image $I_O$ is distributed mostly in the low brightness interval, the original image $I_O$ is determined to be a low brightness image.

The frame rate selecting circuit 140 comprises a control end C, an enable end EN, an output end O, and a frame rate storage device 141. The frame rate storage device 141 is utilized to store the reference frame rates R-$_{F1}$~$R_{F3}$. The control end C of the frame rate selecting circuit 140 is utilized to receive the brightness determining signal $S_I$. When the enable end EN of the frame rate selecting circuit 140 receives the frame triggering signal $TG_F$ representing "enable/reset", according to the brightness determining signal $S_I$, the frame rate selecting circuit 140 selects one of the reference frame rates $R_{F1}$~$R_{F3}$ to be the output frame rate $R_{FO}$, which is utilized to be the frame rate of the display device. More specifically, when the frame rate selecting circuit 140 receives the brightness determining signal $S_I$ representing high brightness, the frame rate selecting circuit 140 selects a relatively lower frame rate from the reference frame rates $R_{F1}$~$F_{N3}$ as the output frame rate $R_{FO}$ for lowering the frame rate of the display device. On the other hand, when the frame rate selecting circuit 140 receives the brightness determining signal $S_I$ representing low brightness, the frame rate selecting circuit 140 selects a relatively higher frame rate from the reference frame rates $R_{F1}$~$F_{N3}$ as the output frame rate $R_{FO}$ for increasing the frame rate of the display device. Therefore, when brightness of the original image $I_O$ is relatively high, the frame rate adjuster 100 lowers the frame rate of the display device to reduce the power consumption of the display device; when the brightness of the original image $I_O$ is relatively low, the frame rate adjuster 100 increases the frame rate of the display device to prevent the occurrence of display flickering.

Figure 2:
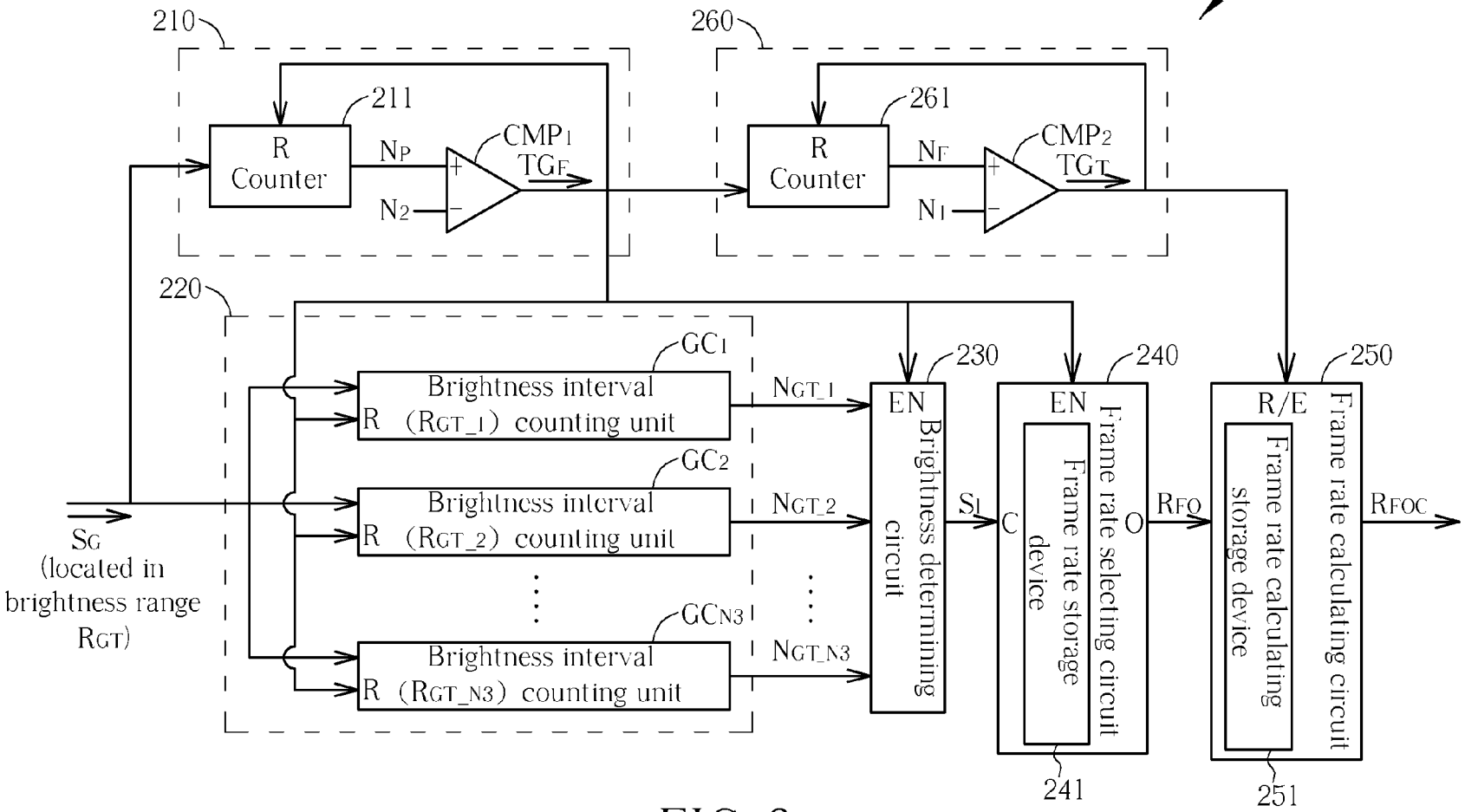
FIG. 2 is a diagram illustrating the frame rate adjuster according to the second embodiment of the present invention.

Please refer to FIG. 2. FIG. 2 is a diagram illustrating the frame rate adjuster 200 according to the second embodiment of the present invention. To prevent the frame rate of the display device from being adjusted too frequently, the frame rate adjuster 200 adjusts the frame rate every interval T. The frame rate adjuster 200 adjusts the frame rate of a display device consisting of $N_2$ pixels according to the brightness of $N_1$ original images $I_{O1}$~$I_{ON1}$ in the interval $T_1$, wherein the duration of the interval $T_1$ equals the duration of the interval T. The frame rate adjuster 200 comprises a frame counting circuit 210, a brightness counting circuit 220, a brightness determining circuit 230, a frame rate selecting circuit 240, a frame rate calculating circuit 250 and an interval counting circuit 260, wherein the structure and the operation principle of the frame counting circuit 210, the brightness counting circuit 220, the brightness determining circuit 230 and the frame rate selecting circuit 240 are similar to that of the frame counting circuit 110, the brightness counting circuit 120, the brightness determining circuit 130 and the frame rate selecting circuit 240; the relative description is therefore omitted hereafter.

The interval counting circuit 260 is utilized to count the frame triggering signal $TG_F$ for determining wither the grey level data of the $N_1$ original images $I_{O1}$~$I_{ON1}$ has been completely transmitted from the grey level signal $S_G$, for generating the interval triggering signal $TG_T$. The interval counting circuit 260 comprises a counter 261 and a comparator $CMP_2$. The counter 261 counts the number $N_F$ of the transmitted original images according to the frame triggering signal $TG_F$. When the counter 261 receives the frame triggering signal $TG_F$ representing "enable/reset", it indicates the grey level of an original image has been completely transmitted and the counter 261 increments the number $N_F$ of the transmitted original images by 1 accordingly. For instances, assuming the number $N_F$ of the transmitted original images is X and when the counter 261 receives the frame triggering signal $TG_F$ representing "enable/reset", the number $N_F$ of the transmitted original images is incremented by 1 to become (X+1). The comparator $CMP_2$ then compares the number $N_F$ of the transmitted original images and the number $N_1$ of the original images, for outputting the interval triggering signal $TG_T$. When the number $N_F$ of the transmitted original images equals the number $N_1$ of the original images, the comparator $CMP_2$ outputs the interval triggering signal $TG_T$ representing "enable/reset", indicating the grey level data corresponding to the number $N_1$ of the original images has been completely transmitted from the grey level signal $S_G$. When the reset end R of the counter 261 receives the interval triggering signal $TG_T$ representing "enable/reset", the counter 261 resets the number $N_F$ of the transmitted original images to a predetermined value (i.e. reset to zero). Therefore, whenever the interval counting circuit 260 determines the grey level data of the number $N_1$ of the original images has been completely transmitted from the grey level signal $S_G$, the interval counting circuit 260 generates the interval triggering signal $TG_T$ representing "enable/reset".

The frame rate calculating circuit 250 is utilized to calculate the output frame rate outputted by the frame rate adjuster 200 after the interval $T_1$. The frame rate calculating circuit 250 further comprises a frame rate calculating storage device 251. When the frame rate calculating circuit 250 receives the output frame rate $R_{FO}$, the frame rate calculating storage device 251 stores the received output frame rate $R_{FO}$. When the frame rate calculating circuit 250 receives the interval triggering signal $TG_T$ representing "enable/reset" corresponding to the interval $T_1$, it indicates that the frame rate calculating storage device 251 has stored the output frame rates $R_{FO1}$~$R_{FON1}$ of $N_1$ original images $I_{O1}$~$I_{ON1}$ corresponding to the interval $T_1$. Concurrently, the frame rate calculating circuit 250 generates a calculated output frame rate $R_{FOC}$ according to the output frame rates $R_{FO1}$~$R_{FON1}$ corresponding to the original images $I_{O1}$~$I_{ON1}$, for adjusting the frame rate of the display device. For instances, assuming $N_1$ is 5 and the output frame rates $R_{RO1}$~$R_{RO5}$ stored in the frame rate calculating storage device 251 are [30 Hz, 30 Hz, 30 Hz, 50 Hz, 60 Hz]. Subsequently, if the frame rate calculating circuit 250 utilizes the median method, the frame rate calculating circuit 250 outputs the calculated output frame rate $R_{FOC}$ representing "30 Hz" (i.e. the median value of the output frame rates). If the frame rate calculating circuit 250 utilizes the averaging method, the frame rate calculating circuit 250 outputs the calculated output frame rate $R_{FOC}$ representing "40 Hz" (i.e. the average of the output frame rates). As a result, when the brightness of the original images $I_{O1}$~$I_{ON1}$ are high, the output frame rates $R_{FO1}$~$R_{FON1}$ are deviated towards a relatively low frame rate. Therefore the frame calculating circuit 250 generates a lower calculated output frame rate $R_{FOC}$ to lower the frame rate of the display device, for reducing the power consumption of the display device. when the brightness of the original images $I_{O1}$~$I_{ON1}$ are low, the output frame rates $R_{FO1}$~$R_{FON1}$ are deviated towards a relatively high frame rate. Therefore the frame calculating circuit 250 generates a higher calculated output frame rate $R_{FOC}$ to increase the frame rate of the display device, for preventing the display flickering of the display device. In addition, after the calculated output frame rate $R_{FOC}$ is generated by the frame rate calculating circuit 250, the frame rate calculating circuit 250 resets (i.e. clear) the output frame rates $R_{FO1}$~$R_{FON1}$ stored in the frame rate calculating storage device 251, so when the frame rate calculating 250 generates the calculated output frame rate $R_{FOC}$ corresponding to the subsequent interval $T_2$, the frame rate calculating 250 is not affected by the output frame rates $R_{FO1}$~$R_{FON1}$ of the original images $I_{O1}$~$I_{ON1}$ corresponding to the interval $T_1$.

Figure 3:
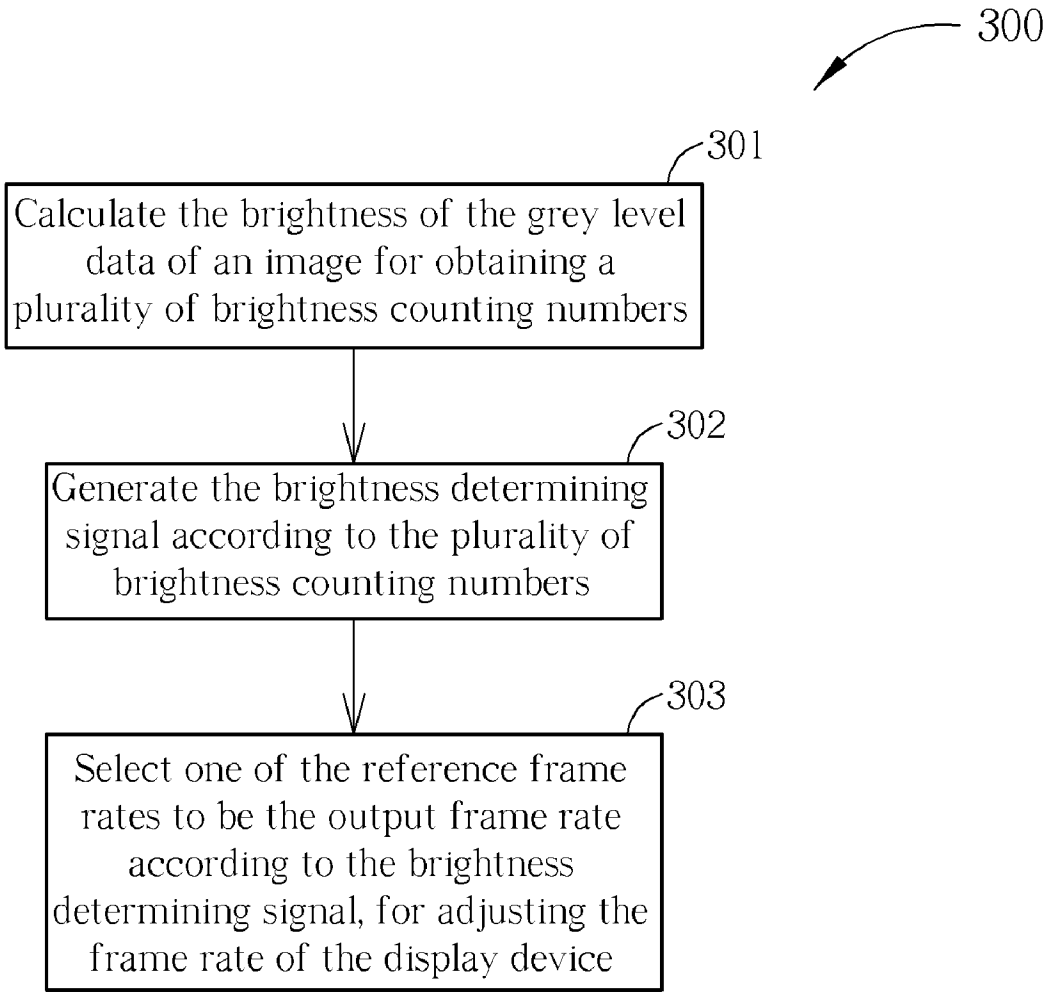
FIG. 3 is a flowchart illustrating the method of adjusting the frame rate according to the third embodiment of the present invention.

Please refer to FIG. 3. FIG. 3 is a flowchart illustrating the method 300 of adjusting the frame rate according to the third embodiment of the present invention. The method 300 of the present invention obtains the output frame rate for adjusting the frame rate of the display device according to the brightness of the original image. The steps of the method 300 of the present invention are detailed as below:

Step 301: calculate the number of pixels of the grey level data of the original image $I_O$ located in each of the brightness intervals $R_{GT_1}$~$R_{GT_N3}$ in the brightness range $R_{GT}$, for obtaining the brightness counting number for each of the brightness intervals $R_{GT_1}$~$R_{GT_N3}$;

Step 302: generate the brightness determining signal $S_I$ according to the brightness counting number of each of the brightness intervals $R_{GT_1}$~$R_{GT_N3}$.

Step 303: selecting one of the $N_3$ reference frame rates to be the output frame rate according to the brightness determining signal $S_I$, for adjusting the frame rate of the display device.

In step 301, for instances, the brightness range $R_{GT}$ represents the range of the grey level 0~255. Assuming $N_3$ is 4, the brightness interval $R_{GT_1}$ represents the range of the grey level 0~63; interval $R_{GT_2}$ represents the range of the grey level 64~127; interval $R_{GT_3}$ represents the range of the grey level 128~191; interval $R_{GT_4}$ represents the range of the grey level 192~255.

In Step 302, the brightness counting number of each of the brightness intervals $R_{GT_1}$~$R_{GT_N3}$ is compared for obtaining a maximum brightness counting number. For instances, if the value of the brightness counting number $N_{GTK}$ is lager than the other brightness counting number, the brightness of the original image $I_O$ is mostly distributed in the brightness interval $R_{GT_K}$. Therefore, the brightness determining signal $S_I$ is then "K", for representing where the brightness distribution of the original image $I_{O1}$ is mostly located.

In Step 303, according to the brightness determining signal $S_I$, the core distribution of the brightness of the original image $I_{O1}$ can be acquired for determining if the brightness of the original image $I_{O1}$ is high. Therefore, when the brightness of the original image $I_{O1}$ is high, a lower reference frame rate can be selected accordingly to be the output frame rate $R_{FO}$ to lower the frame rate of the display device, for reducing the power consumption of the display device; when the brightness of the original image $I_{O1}$ is low, a higher reference frame rate can then be selected accordingly to be the output frame rate $R_{FO}$ to increase the frame rate of the display device, for preventing the display flickering of the display device.

Figure 4:
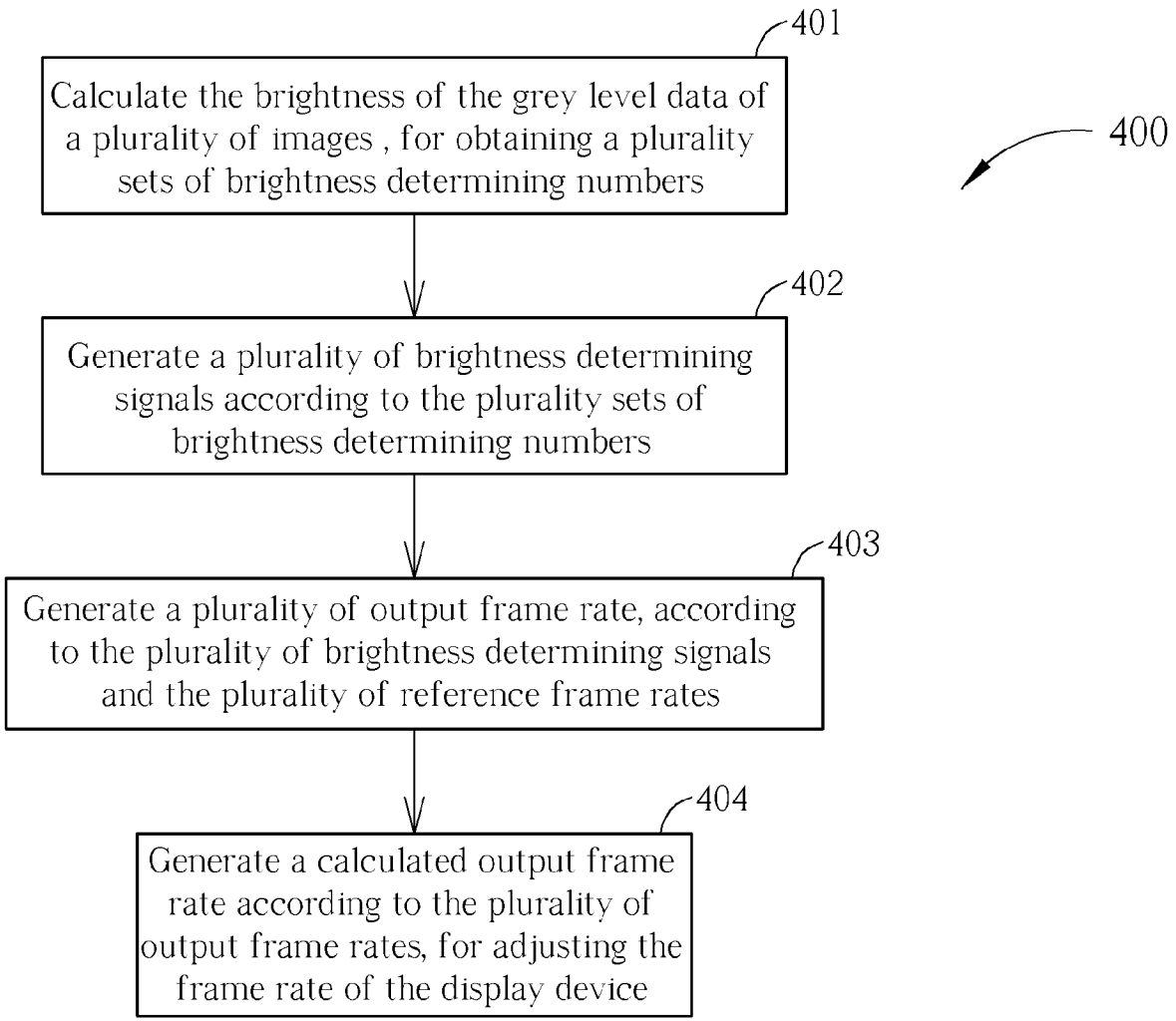
FIG. 4 is a flowchart illustrating the method of adjusting the frame rate according to the fourth embodiment of the present invention.

Please refer to FIG. 4. FIG. 4 is a flowchart illustrating the method 400 of adjusting the frame rate according to the fourth embodiment of the present invention. The method 400 of the present invention is to obtain the calculated output frame rate $R_{FOC}$ according to the brightness of $N_1$ original images corresponding to an interval $T_1$, for adjusting the frame rate of the display device. The steps of the method 400 of the present invention are detailed as below:

Step 401: calculate the number of pixels of the grey level data of $N_1$ original images located in each of the brightness intervals $R_{GT_1}$~$R_{GT_N3}$ in the brightness range $R_{GT}$, according to the grey level data of the $N_1$ original images corresponding to an interval $T_1$;

Step 402: generate $N_1$ brightness determining signals $S_{I1}$~$S_{IN1}$ corresponding to the $N_1$ original images, according to the brightness determining number of the grey level data of $N_1$ original images located in each of the brightness intervals $R_{GT_1}$~$R_{GT_N3}$ in the brightness range $R_{GT}$;

Step 403: select one of the $N_3$ reference frame rates to be the output frame rate $R_{FO1}$~$R_{FON1}$, according to the brightness determining signals $S_{I1}$~$S_{IN1}$;

Step 404: generate the calculated output frame rate $R_{FOC}$ according to the output frame rate $R_{FO1}$~$F_{ON1}$, for adjusting the frame rate of the display device.

The operation flow and principle of the steps 401~403 are similar to those of the steps 301~303; the relative description is therefore omitted hereafter. In step 404, for instances, the median method is utilized to obtain the median value of the output frame rates $R_{FON1}$~$R_{FON1}$, for being employed as the calculated output frame rate $R_{FO}$C; or alternatively, the averaging method is utilized to obtain the average value of the output frame rates $R_{FON1}$~$R_{FON1}$, for being employed as the calculated output frame rate $R_{FOC}$. As a result, when the brightness of the $N_1$ original images are relatively higher, the output frame rates $R_{FO1}$~$R_{FON1}$ are deviated towards a relative lower frame rate, so a lower calculated output frame rate $R_{FO}$C is accordingly generated for lowering the frame rate of the display device, to reduce the power consumption of the display device; when the brightness of the $N_1$ original images are of a relative lower, the output frame rates $R_{FO1}$~$R_{FON1}$ are deviated towards a relative higher frame rate, so a higher calculated output frame rate $R_{FOC}$ is accordingly generated for increasing the frame rate of the display device, to prevent the display flickering of the display device.

Furthermore, the above-mentioned display devices can be realized with a Liquid Crystal Display (LCD), a Plasma Display (PDP), or an Organic Light-Emitting Diode (OLED).

In conclusion, the frame rate adjuster of the present invention is able to determine the brightness of the original image according to the grey level data of the original image. The output frame rate is then obtained according to the brightness of the original image, for adjusting the frame rate of the display device. Therefore, when displaying frames of low brightness, the display device can utilize a higher frame rate for preventing display flickering; on the other hand, when displaying frames of high brightness, the display device can utilize a lower frame rate for reducing the power consumption of the display device, providing great convenience.

Those skilled in the art will readily observe that numerous modifications and alterations of the device and method may be made while retaining the teachings of the invention.

What is claimed is:

1. A frame rate adjuster, for adjusting a frame rate of a display device according to brightness of a frame, the frame rate adjuster comprising:

a frame counting circuit, for receiving the frame and counting a number of received grey level data of the frame to determine if the frame has been completely received, for generating a frame triggering signal;

wherein when the frame counting circuit determines the frame has been completely received, the frame counting circuit generates the frame triggering signal representing enable/reset;

a brightness counting circuit, for receiving the frame and counting number of the grey level data of the frame within each of brightness intervals, for accordingly generating a plurality of brightness counting numbers corresponding to the brightness intervals;

wherein when the frame triggering signal represents enable/reset, the brightness counting circuit resets the plurality of the brightness counting numbers;

a brightness determining circuit, for outputting a brightness determining signal according to the frame triggering signal and a highest brightness counting number of the plurality of the brightness counting numbers;

wherein when the frame triggering signal represents enable/reset, the brightness determining circuit outputs the brightness determining signal according to the highest brightness counting number of the plurality of the brightness counting numbers; and a frame rate selecting circuit, comprising:

a control end, for receiving the brightness determining signal;

an enable end, for receiving the frame triggering signal; and an output end, for generating an output frame rate;

wherein when the frame triggering signal represents enable/reset, the frame rate selecting circuit selects one of a plurality of reference frame rates to be the output frame rate according to the brightness determining signal, and the output frame rate is utilized as the frame rate of the display device.

2. The frame rate adjuster of claim 1, wherein when the brightness determining signal represents high brightness, the frame rate selecting circuit selects one reference frame rate of a lower frequency from the plurality of the reference frame rates as the output frame rate.

3. The frame rate adjuster of claim 1, wherein when the brightness determining signal represents low brightness, the frame rate selecting circuit selects one reference frame rate of a higher frequency from the plurality of the reference frame rates as the output frame rate.

4. The frame rate adjuster of claim 1, wherein the frame counting circuit comprises:

a counter, for counting the number of the received grey level data of the frame, comprising:

an input end, for receiving the frame;

an output end, for outputting the number of the received grey level data of the frame; and a reset end, for receiving the frame triggering signal;

wherein when the frame triggering signal represents enable/reset, the counter is reset;

a comparator, for comparing the number of the received grey level data of the frame and a number of grey level data comprised in the frame, for outputting the frame triggering signal;

wherein when the number of the received grey level data of the frame equals the number of the grey level data comprised in the frame, the comparator outputs the frame triggering signal which represents enable/reset.

5. The frame rate adjuster of claim 1, wherein the brightness counting circuit comprises:

a plurality of brightness interval counting units, for receiving the frame;

wherein an $M^{th}$ brightness interval counting unit of the plurality of brightness interval counting units is utilized to count a number of the grey level data of the frame located in a brightness interval corresponding to the $M^{th}$ brightness interval counting unit, for accordingly outputting an $M^{th}$ brightness counting number;

wherein M represents a positive integer.

6. The frame rate adjuster of claim 1, wherein when a $K^{th}$ brightness counting number of the plurality of the brightness counting numbers is larger than the other brightness counting numbers of the plurality of the brightness counting numbers, the brightness determining signal represents K and the frame rate selecting circuit selects a reference frame rate from the plurality of reference frame rates to be the output frame rate, according to the brightness determining signal which represents K, wherein K represents a positive integer.

7. The frame rate adjuster of claim 1, wherein when the frame rate selecting circuit comprises:

a frame rate storage device, for storing the plurality of the reference frame rates.

8. The frame rate adjuster of claim 1, wherein the display device can be realized with a Liquid Crystal Display (LCD) device, a Plasma Display (PDP) device, or an Organic Light-Emitting Diode (OLED) display device.

9. A frame rate adjuster, for adjusting a frame rate of a display device according to brightness of a predetermined number of frames, the frame rate adjuster comprising:

a frame counting circuit, for receiving the predetermined number of the frames and counting a number of received grey level data of the predetermined number of the frames, to determine if an frame of the predetermined number of the frames has been completely received, for generating a frame triggering signal;

wherein when the frame counting circuit determines the frame of the predetermined number of the frames has been completely received, the frame counting circuit generates the frame triggering signal representing enable/reset;

an interval counting circuit, for counting a number of times the frame triggering signal represents enable/reset, for determining if the predetermined number of the frames have been completely transmitted, and accordingly generating an interval triggering signal;

wherein when the number of times the frame triggering signal represents enable/reset equals the predetermined number, the interval counting circuit generates the interval triggering signal representing enable/reset;

a brightness counting circuit, for receiving the predetermined number of the frames, and counting number of the grey level data of the predetermined number of the frames within each of brightness intervals, for generating a plurality of brightness counting numbers corresponding to the brightness intervals;

wherein when the frame triggering signal represents enable/reset, the brightness counting circuit resets the plurality of the brightness counting numbers;

a brightness determining circuit, for outputting a brightness determining signal according to the frame triggering signal and a highest brightness counting number of the plurality of the brightness counting numbers;

wherein when the frame triggering signal represents enable/reset, the brightness determining circuit outputs the brightness determining signal according to the highest brightness counting number of the plurality of the brightness counting numbers;

a frame rate selecting circuit, comprising:

a control end, for receiving the brightness determining signal;

an enable end, for receiving the frame triggering signal; and an output end, for generating an output frame rate;

wherein when the frame triggering signal represents enable/reset, the frame rate selecting circuit selects one of plurality of reference frame rates to be the output frame rate according to the brightness determining signal; and a frame rate calculating circuit, for receiving and storing the output frame rate outputted from the frame rate selecting circuit, and generating a calculated output frame rate as the frame rate of the display device, according to the stored output frame rate when the interval triggering signal representing enable/reset is received.

10. The frame rate adjuster of claim 9, wherein when the brightness determining signal represents high brightness, the frame rate selecting circuit selects one reference frame rate of a lower frequency from the plurality of the reference frame rates as the output frame rate.

11. The frame rate adjuster of claim 9, wherein when the brightness determining signal represents low brightness, the frame rate selecting circuit selects one reference frame rate of a higher frequency from the plurality of the reference frame rates as the output frame rate.

12. The frame rate adjuster of claim 9, wherein the frame counting circuit comprises:

a counter, for receiving the frame and counting the number of the received grey level data of the frame, comprising:

an input end, for receiving the frame;

an output end, for outputting the number of the received grey level data of the frame; and a reset end, for receiving the frame triggering signal;

wherein when the frame triggering signal represents enable/reset, the counter is reset;

a comparator, for comparing the number of the received grey level data of the frame and a number of grey level data comprised in the frame, for outputting the frame triggering signal;

wherein when the number of the received grey level data of the frame equals the number of the grey level data comprised in the frame, the comparator outputs the frame triggering signal which represents enable/reset.

13. The frame rate adjuster of claim 9, wherein the interval counting circuit comprises:

a counter, for receiving the frame triggering signal to calculate the number of times the frame triggering signal representing enable/reset, comprising:

an input end, for receiving the frame triggering signal;

an output end, for outputting the interval triggering signal; and a reset end, for receiving the interval triggering signal;

wherein when the interval triggering signal represents enable/reset, the counter is reset; and a comparator, for comparing the number of times the frame triggering signal represents enable/reset and accordingly outputting the interval triggering signal;

wherein when the number of times the frame triggering signal represents enable/reset equals the predetermined number, the comparator outputs the interval triggering signal representing enable/reset.

14. The frame rate adjuster of claim 9, wherein the brightness counting circuit comprises:

a plurality of brightness interval counting units;

wherein an $M^{th}$ brightness interval counting unit of the plurality of the brightness interval counting units is utilized to count a number of the grey level data of the frame located in a brightness interval corresponding to the $M^{th}$ brightness interval counting unit of the plurality of the brightness interval counting units, for outputting an $M^{th}$ brightness counting number;

wherein M represents a positive integer.

15. The frame rate adjuster of claim 9, wherein when a $K^{th}$ brightness counting number of the plurality of the brightness counting numbers is larger than the other brightness counting numbers of the plurality of the brightness counting numbers, the brightness determining signal represents K and the frame rate selecting circuit selects a reference frame rate from the plurality of the reference frame rates to be the output frame rate according to the brightness determining signal representing K, wherein K represents a positive integer.

16. The frame rate adjuster of claim 9, wherein the frame rate selecting circuit comprises:

a frame rate storage device, for storing the plurality of the reference frame rates.

17. The frame rate adjuster of claim 9, wherein when the frame rate calculating circuit utilizes a median method, the frame rate calculating circuit outputs a median value of the output frame rates stored in the frame rate calculating circuit, and the median value of the output frame rates stored in the frame rate calculating circuit is utilized as the calculated output frame rate.

18. The frame rate adjuster of claim 9, wherein when the frame rate calculating circuit utilizes an averaging method, the frame rate calculating circuit outputs an average value of the output frame rates stored in the frame rate calculating circuit, and the average value of the output frame rates stored in the frame rate calculating circuit is utilized as the calculated output frame rate.

19. The frame rate adjuster of claim 9, wherein the display device can be realized with an LCD device, a PDP device, or an OLED display device.

20. A method for adjusting a frame rate of a display device according to brightness of a frame, the method comprising:

counting number of grey level data of the frame within each of brightness intervals for obtaining a plurality of brightness counting numbers corresponding to the brightness intervals;

generating a brightness determining signal according to a highest brightness counting number of the plurality of the brightness counting numbers; and selecting one reference frame rate from a plurality of reference frame rates to be an output frame rate, according the brightness determining signal, and utilizing the output frame rate for adjusting the frame rate of the display device.

21. The method of claim 20, wherein generating the brightness determining signal according to the highest brightness counting number of the plurality of the brightness counting numbers comprises:

comparing the plurality of the brightness counting numbers, for obtaining an $M^{th}$ brightness counting number of the plurality of the brightness counting numbers, and generating the brightness determining signal which represents M;

wherein the $M^{th}$ brightness counting number of the plurality of the brightness counting numbers is larger than the other brightness counting numbers of the plurality of the brightness counting numbers;

wherein M represents a positive integer.

22. The method of claim 20, wherein when the brightness determining signal represents M, the output frame rate is selected from the plurality of the reference frame rates according to the brightness determining signal which represents M.

23. The method of claim 20, wherein selecting the reference frame rate from the plurality of the reference frame rates to be the output frame rate according the brightness determining signal, and utilizing the output frame rate for adjusting the frame rate of the display device comprises:

determining if the brightness of the frame is high according to the brightness determining signal;

when the brightness of the frame is high, selecting the reference frame rate of a lower frequency as the output frame rate, from the plurality of the reference frame rates; and when the brightness of the frame is low, selecting the reference frame rate of a higher frequency as the output frame rate, from the plurality of the reference frame rates.

24. The frame rate adjuster of claim 20, wherein the display device can be realized with an LCD device, a PDP device, or an OLED display device.

25. A method for adjusting a frame rate of a display device according to brightness of a predetermined number of frames, the method comprising:

counting number of grey level data of the predetermined number of the frames within each of brightness intervals, for obtaining the predetermined number of sets of brightness counting numbers corresponding to the brightness intervals;

wherein each set of the brightness counting numbers of the predetermined number of sets of the brightness counting numbers comprises a plurality of brightness counting numbers;

wherein an $M^{th}$ set of the brightness counting number of the predetermined number of sets of the brightness counting numbers is obtained by calculating an $M^{th}$ frame from the predetermined number of the frames;

generating the predetermined number of the brightness determining signals according to highest brightness counting numbers of the predetermined number of the sets of the brightness counting numbers;

generating the predetermined number of output frame rates according to the predetermined number of the brightness determining signals and a plurality of reference frame rates; and generating a calculated output frame rate according to the predetermined number of the output frame rates, for adjusting the frame rate of the display device;

wherein M represents a positive integer.

26. The method of claim 25, wherein generating the calculated output frame rate according to the predetermined number of the output frame rates, for adjusting the frame rate of the display device comprising:

when frequencies of the predetermined number of the output frame rates are relatively low, generating the calculated output frame rate of a lower frequency; and when frequencies of the predetermined number of the output frame rates are relatively high, generating the calculated output frame rate of a higher frequency.

27. The method of claim 25, wherein generating the predetermined number of the output frame rates according to the predetermined number of the brightness determining signals and the plurality of the reference frame rates comprises:

determining if the brightness of the predetermined number of the frames is high according to the predetermined number of the brightness determining signals;

when the brightness of a $K^{th}$ frame of the predetermined number of the frames is high, selecting one reference frame rate of a lower frequency from the plurality of reference frame rates to be an output frame rate corresponding to the $K^{th}$ frame of the predetermined number of the output frame rates; and when the brightness of the $K^{th}$ frame of the predetermined number of the frames is low, selecting one reference frame rate of a higher frequency from the plurality of the reference frame rates to be the output frame rate corresponding to the $K^{th}$ frame of the predetermined number of the output frame rates;

wherein K represents a positive integer.

28. The method of claim 25, wherein generating the calculated output frame rate according to the predetermined number of the output frame rates, for adjusting the frame rate of the display device comprises:

utilizing an averaging method to obtain an average value of the predetermined number of the output frame rates, and utilizing the average value of the predetermined number of the output frame rates as the calculated output frame rate.

29. The method of claim 25, wherein generating the calculated output frame rate according to the predetermined number of the output frame rates, for adjusting the frame rate of the display device comprises:

utilizing a median method to obtain a median value of the predetermined number of the output frame rates, and utilizing the median value of the predetermined number of output frame rates as the calculated output frame rate.

30. The frame rate adjuster of claim 25, wherein the display device can be realized with an LCD device, a PDP device, or an OLED display device.

* * * * *